United States Patent [19]

Jack

[11] Patent Number: 4,976,456

[45] Date of Patent: Dec. 11, 1990

[54] MARKING SYSTEM

[75] Inventor: David E. Jack, Irvine, Calif.

[73] Assignee: Prevent-A-Crime International, Inc., Santa Ana, Calif.

[21] Appl. No.: 250,314

[22] Filed: Sep. 28, 1988

[51] Int. Cl.[5] ..... B42D 15/00

[52] U.S. Cl. ..... 283/70; 283/105; 283/901; 283/81

[58] Field of Search ..... 283/17, 81, 70, 100, 283/105, 901

[56] References Cited

U.S. PATENT DOCUMENTS

| | | | |
|---|---|---|---|
| 1,474,706 | 11/1923 | Cardell | 283/70 |
| 2,324,885 | 7/1943 | Sherrill | 283/105 X |
| 4,109,047 | 8/1978 | Fredrickson | 283/70 X |
| 4,239,261 | 12/1980 | Richardson | 283/901 X |
| 4,660,859 | 4/1987 | Natesh | 283/70 |
| 4,725,078 | 2/1988 | Janicki | 283/70 |

FOREIGN PATENT DOCUMENTS

| | | | |
|---|---|---|---|
| 3211102 | 10/1983 | Fed. Rep. of Germany | 283/901 |

OTHER PUBLICATIONS

*Tricks Every Boy Can Do;* Todd, Joseph P; Hart, (New York, 1948) p. 20.

*Primary Examiner*—Paul A. Bell

*Attorney, Agent, or Firm*—Knobbe, Martens, Olson & Bear

[57] ABSTRACT

A label formed of a plastic film having a mottled background on its lower surface, which is covered by a layer of adhesive and a backing strip. The label has an invisible identifier on its upper surface which becomes visible when a marking pen is applied to it and the excess material around the identifier is wiped away.

18 Claims, 1 Drawing Sheet

MARKING SYSTEM

FIELD OF THE INVENTION

This invention relates to marking articles and particularly relates to a system useful to identify stolen property and to deter theft.

BACKGROUND OF THE INVENTION

Determining whether certain goods represent stolen property, and further identifying specific stolen property has been and continues to be a challenging problem. For example, vehicle theft and the resale of the stolen property is an enormous business. While vehicles have an identification number which would-be buyers or law enforcement personnel can check to see whether a particular vehicle is stolen, a large percentage of the stolen vehicles are dismantled and the components sold. Further, many vehicle components are initially stolen separately. Major examples in this latter category are stereo sets and vehicle seats. Currently, Toyota truck seats of a particular type happen to be a popular item for stealing. While stereo sets often have identifying numbers, vehicle seats normally do not. Further, even if a component has an identifying number, a thief may deface an obvious number or remove that portion of the component.

A need exists for a reliable, practical and reasonably priced system for marking items and for identifying property, particularly stolen property, and it is the object of this invention to provide such an improved system.

SUMMARY OF THE INVENTION

In accordance with the invention, a label to be applied to an article is provided with an identifying number or other indicia marked thereon by an impression or other means in a manner such that the identification data is invisible or difficult to be seen by a casual human observer. By applying a marking pen or other such implement to the label, the indicia becomes visible, particularly if the marking material surrounding the indicia is wiped away.

In a preferred form of the invention, the label is a thin layer of transparent polyester or other suitable plastic. An identifier, such as a vehicle identification number, is applied to the top surface of the label by passing the label through a printer or other such device which will make a physical impression in the label but which does not contain ink or other usual marking material that would make the number visible. To help mask the presence of the number, the back side of the label is printed or otherwise covered in a manner to hide the impression. A mottled background is particularly useful for camouflaging the number impression.

In utilizing the system of the invention to identify stolen property, the possessor of the stolen property is not aware that there is an identifying number or other indicia on the label. Instead, the label may conveniently have other visible marking on it, such as being marked with the phrase "genuine parts", or with the manufacturer's name, or with an insurance company's name. If the property is suspected of being stolen, a law enforcement official, insurance adjuster, or other person having knowledge of the marking system can simply apply a marking implement to the area of the label where the invisible identification number is located. The label is then wiped clean leaving markings in or on the impression that are visible so as to make the identifying number visible The number can then be checked with a list of stolen property numbers.

DETAILED DESCRIPTION OF A PREFERRED EMBODIMENT OF THE INVENTION

Figure 1:
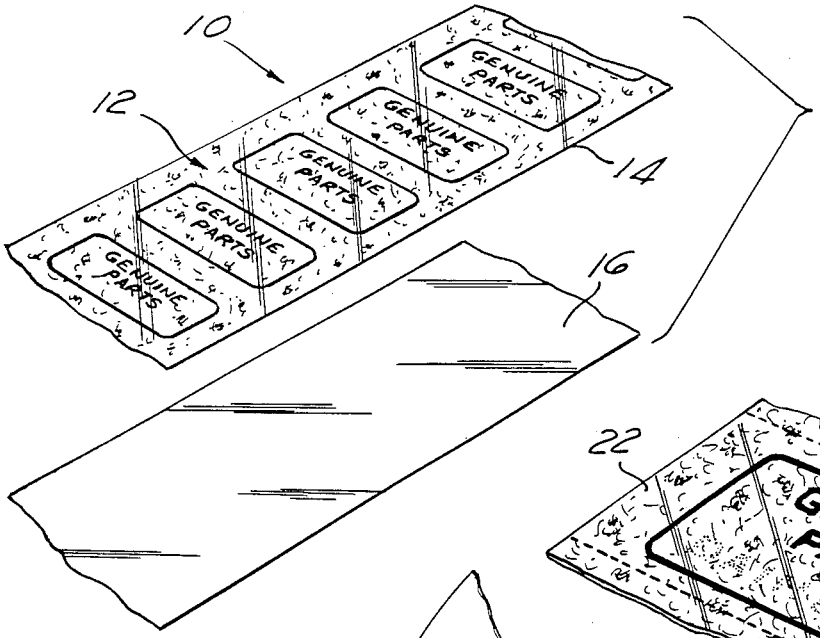
FIG. 1 is an exploded perspective view of a strip of labels.
Figure 2:
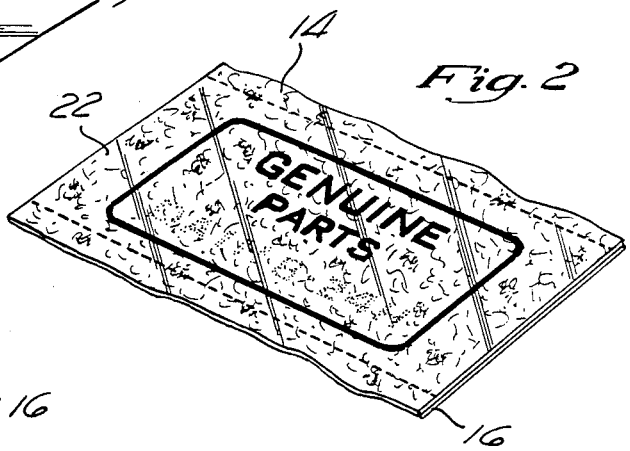
FIG. 2 is a perspective view from the top side of a single label of FIG. 1.
Figure 4:
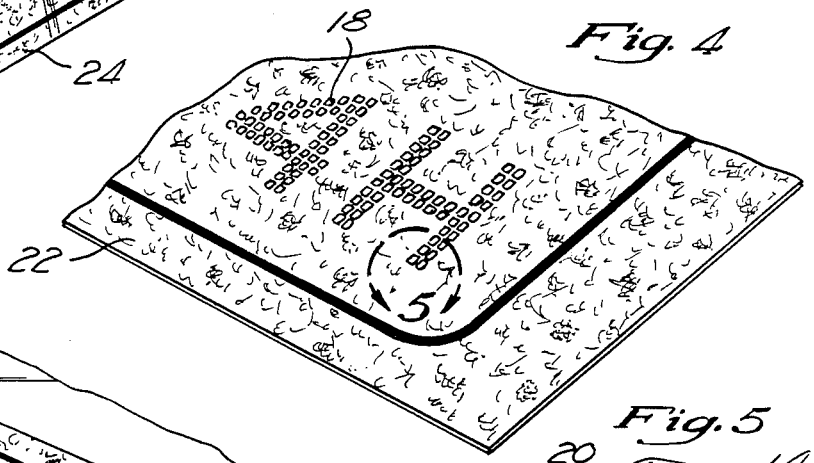
FIG. 4 is an enlarged, fragmentary view of a label exaggerating the impressions on the label forming an identifying number so that the impressions are somewhat visible.
Figure 5:
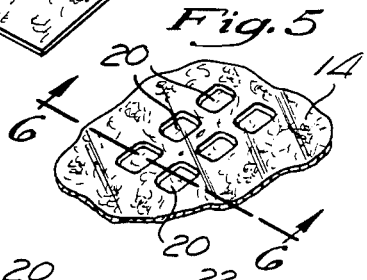
FIG. 5 is a further enlargement of the label in FIG. 4 to illustrate the impressions formed therein.
Figure 6:
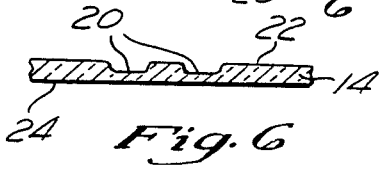
FIG. 6 is a cross-sectional view on line 6—6 of FIG. 5 illustrating two impressions in the surface of the label.

FIG. 1 illustrates an elongated flexible strip 10 of interconnected labels 12. Each of the labels comprises a thin flexible layer or film 14 of durable, preferably transparent material and a backing strip 16. In a preferred form of the invention, the layer is of polyester, approximately 0.002 inches thick. An identifier 18, FIG. 4, such as a number or other desired indicia is formed on or in the layer or film by making one or more impressions 20 in the film's top surface 22 as seen in FIGS. 5 and 6 as physical depressions. In a prototype of the invention, the impressions were made by passing the strip of labels through a dot matrix or a line printer with the usual "ink" or visible marking means of such a printer not being used. As a result the mere physical impressions are made in the top surface of the material, but they are substantially invisible to a casual observer, and can only be detected by very careful scrutiny. The number 18 in FIG. 4 and the impression 20 of FIG. 5 have been enlarged and exaggerated for purposes of illustration, but they are substantially invisible so that the label appears as shown in FIGS. 1, 2 and 3.

The impressions 20 can be made by any suitable means other than a printer. Further, the impressions are shown in FIG. 5 as having a generally rectangular shape with rounded corners, but any desired shape may be utilized, including a variety of shapes forming a particular identifier 18. FIG. 6 shows the impressions 20 with a depth of about half that of the film 14. The particular depth is not critical and various depths may be used in a single identifier 18. It is only critical that the top surface 22 be permanently deformed so that the identifier can be made visible. The impressions 20 can possibly "cut" or "tear" or "scar" the top surface 22, or the film material could be disrupted upwardly so long as this does not make the mark visible. The impressions 20 can possibly penetrate the lower surface 24 of the film 14, so long as the mark remains invisible, and the integrity of the film is kept intent. In this regard, it should be noted that the word "impression" is intended to mean any physical disruption or depression that will remain in the film.

Figure 3:
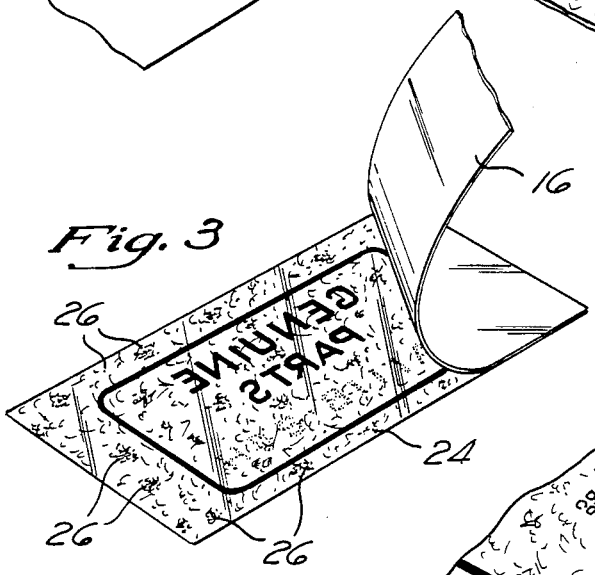
FIG. 3 is a perspective view from the backside of a single label as the release paper backing layer is being removed.

The backside 24 of the film 14, as seen if FIG. 3, preferably has printing 26 thereon, providing a background pattern which preferably has an appearance that further masks the impressions formed in the top surface, so that the impressions are even more difficult to detect. A mottled appearance, such as shown in the drawing, is particularly useful for this purpose. As an alternative to printing the back surface, the mottled appearance, can be provided by a separate layer of paper or plastic having that appearance.

An adhesive layer, not shown, is applied to the backside of the film 14 and covered by the backing strip 16. This completes the label. When the label is to be applied, the backing strip 16 is removed, as shown in FIG. 3. The adhesive could, of course, be applied when attaching the label to an object such that the backing strip would not be used. Further, a label could be applied by means other than adhesive.

Figure 7:
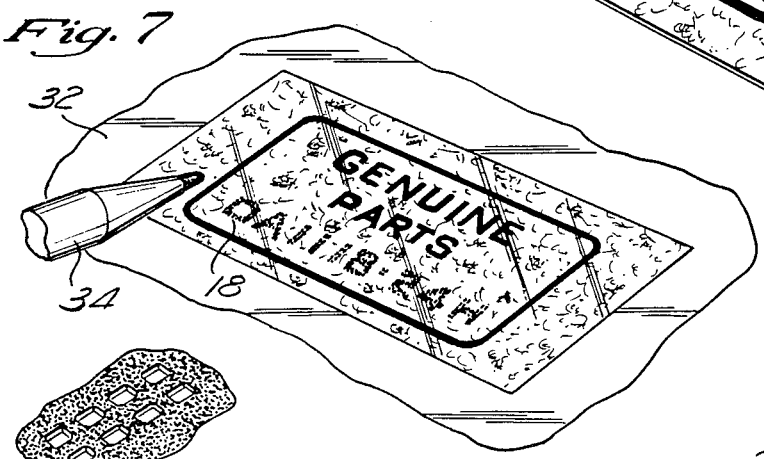
FIG. 7 is a perspective view of a label on which marking material has been applied to make an identifying number clearly visible after the other marking material surrounding the number has been wiped away.

While the labels may be used for a variety of purposes, they were designed for use in identifying pieces of property that are subject to being stolen. As mentioned above, Toyota truck seats are currently popular items to be stolen. Once separated from the vehicle, there has not been a satisfactory means to determine whether the goods were stolen. With the label of the invention applied to an article 32, a law enforcement officer or insurance adjuster or other person trying to determine whether the goods are stolen can simply take a marking pen or pencil 34 and apply marking material onto the area having the identification number impressions 20. The marking material can then be wiped away from the smooth surface of the label, while the material in the impressions 20 remains. This leaves the identification number 18 clearly visible, as seen in FIG. 7. The number can then be checked with a list of stolen property to see whether that number appears on the list.

Figure 8:
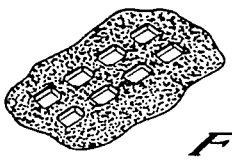
FIG. 8 schematically illustrates an alternative situation wherein marking material is only applied around impressions so as to make impressions visible.

Depending upon the nature of the marking implement and how it is applied, the identification number become visible even before the excess material is wiped away. That is apparently because the marking material may be applied more evenly and uniformly to the smooth surface of the label which does not have an impression, while there is less material actually entering the impressions 20, thus providing a visible contrast. An exaggerated example of this is shown in FIG. 8.

While a variety of label material may be employed, one that has been found to be particularly suitable is currently available from Avery International of Azuza, Calif. and is identified as GENUGRAPHICS. That product already has a printed background 26 on the backside 24 of a polyester film 14 together with the adhesive backing strip 16. Further, it may be ordered with words such as "genuine parts" printed on the film's back, as shown in the drawing, or with any other desired nomenclature or information, such as the manufacturer's name, an insurer's name or use or case instructions. Thus, it is only necessary to form the impressions 20 on the label to make the desired, essentially invisible indicia. The impressions can be applied by the label manufacturer, the manufacturers of the part to be identified, an insurance company, an intermediate agency controlling or conducting the identifying system, or an end user of the part being marked.

While a variety of label materials may be employed, it is desirable to have a strong durable material which can be easily applied to the desired article and cannot be easily defaced or destroyed. It is also desirable that the material be sufficiently impressionable that a permanent impression can be formed in one surface and that the material remain sufficiently strong after the impressions have been made. Although a layer of 0.002 inch polyester works well, the thickness is not critical. However, it is preferable that the material be thick enough such that the impressions do not go completely through the material or that the surface of the material not be altered so much that the impressions become readily visible. It is also desirable that the material have a relatively smooth, slick surface such that "ink" from a marking pen or "graphite" from a pencil can be readily wiped away. Transparent material is desirable for several reasons, but opaque material, colored or uncolored, is satisfactory so long as the identifier 18 is initially invisible, and is capable of becoming usable. The material should be able to withstand the extremes of temperature and other environmental conditions to which it may be subjected over a long period of time, while still maintaining the impressions with sufficient accuracy that the identifier 18 can be made visible in the manner outlined above.

A label can of course be removed. If it is indicated on the label that the label is not to be removed, its absence provides an indication that the property is stolen and may make it unmarketable. Further, a substance may be impregnated in the adhesive that will remain on the property and be detectable after the label is removed. One example of this might be a florescent material.

It is also possible to apply the impressions 20 directly to an article rather than use a label, if the article has a surface having the desired characteristics to accomplish the marking system outlined above. The main requirement is of course that the impressions 20 in the area to be marked can be made in a practical, permanent manner.

While the system has been primarily described as being useful to identify property for the purpose of preventing theft and identifying stolen property, the system may be useful for a wide variety of other purposes or situations in which it is desirable that the presence of the identifier is initially not apparent, but is later made so in a simpler manner. Also, while called an identifier, the impression may be desirable for many purposes other than identifying an article, such as marking to locate an area, or such as merely providing information, for whatever purpose.

What is claimed:

1. A method of marking property, comprising: forming in an impressionable label a physical impression which is substantially invisible to the casual observer;

applying visible marking material to said physical impression and its surrounding area when it is desired to make the physical impression visible; and wiping said surrounding are to remove the marking material, which results in removing the material surrounding the physical impression while leaving marking material in the physical impression to form visible indicia.

2. The method of claim 1, wherein said label is made of transparent material, and including the step of applying a visible background to the backside of the label, which helps to make said impression invisible.

3. The method of claim 2, including applying an adhesive to the backside of said label for applying the label to said property.

4. The method of claim 1, wherein said label is transparent, and including the step of applying masking material to the backside of said label, with said masking having an appearance visible through the label which helps make the impressions invisible from the top side of the label.

5. The method of claim 1, wherein said label is made of a transparent plastic film, and said visible marking material is applied to the top surface of the label with a marking pen or similar implement wherein the marking material is easily wiped off the surface of the label except in the area of said impressions.

6. A label to be applied to an article on which a marking is desired, said label comprising a thin layer having a permanent physical impression in its upper surface which is substantially invisible, said layer upper surface, except in the area of said impression having characteristics such that the visible material from a marking implement will not readily adhere to the layer, but instead can be readily removed except in the area of said impression, whereby the impression on the label can be made visible.

7. The label of claim 6, wherein said layer is a plastic film.

8. The label of claim 7, wherein the film is made of polyester about 0.002 inch thick.

9. The label of claim 7, wherein the film is made of transparent material.

10. The label of claim 9, wherein there is background on the lower surface of the label which masks the impression.

11. The label of claim 10, wherein the background is printed directly on the lower surface of the layer.

12. The label of claim 6, wherein said impression does not extend completely through the layer.

13. The label of claim 6, wherein said impression is a permanent scarring in the surface of the label.

14. The label of claim 6, wherein said impression is identifying indicia.

15. The label of claim 6, wherein said impression is formed by a physical imprinting device which does not have visible marking material on it.

16. A label comprising a thin, flexible, transparent layer of plastic film, a permanent physical impression in the top surface of the film which is substantially invisible to a casual human observer, said impression being formed such that "ink" from a marking pen will adhere to the impression and cannot be wiped away, while the "ink" can be readily wiped away from the surface of the film surrounding the impression to create indicia on the film, a background on the lower surface of the film which further masks the presence of the impression, a layer of adhesive on the background surface of the label, and a removable backing strip covering the adhesive.

17. The label of claim 16, in combination with an article to be identified by the label in determining whether the article is stolen property.

18. A method of marking property, comprising:

forming on the top surface of a thin, transparent label to be applied to said property, a physical impression which is substantially invisible to the casual observer, said impression being formed by permanently scarring or creating a depression in the top surface of the label with a printing device without the use of a visible printing "ink", and applying visible marking material to the area of said impression when it is desired to make the impression visible.

* * * * *